US006155398A

United States Patent [19]

Sagady

[11] Patent Number: 6,155,398

[45] Date of Patent: Dec. 5, 2000

[54] DETECTION SYSTEM

[75] Inventor: Cary M. Sagady, Chester Springs, Pa.

[73] Assignee: Mars Incorporated, McLean, Va.

[21] Appl. No.: 09/340,569

[22] Filed: Jun. 28, 1999

[51] Int. Cl.[7] ..... G07C 3/00; G07D 7/00

[52] U.S. Cl. ..... 194/200; 194/202

[58] Field of Search ..... 194/200, 202, 194/203; 379/145

[56] References Cited

U.S. PATENT DOCUMENTS

| | | | |
|---|---|---|---|
| 2,237,132 | 4/1941 | Christensen . | |
| 3,921,003 | 11/1975 | Greene . | |
| 4,565,275 | 1/1986 | Hagiwara . | |
| 4,666,027 | 5/1987 | Ostroski et al. | 194/200 |
| 5,219,059 | 6/1993 | Furuya et al. | 194/200 |
| 5,366,058 | 11/1994 | Kurosu . | |
| 5,787,158 | 7/1998 | Anello et al. | 379/145 |
| 5,791,450 | 8/1998 | Oden . | |

FOREIGN PATENT DOCUMENTS

| | | | |
|---|---|---|---|
| 90 132/91 | 12/1992 | Australia | 194/202 |
| 53-36299 | 4/1978 | Japan | 194/200 |

*Primary Examiner*—Robert P. Olszewski
*Assistant Examiner*—Bryan Jaketic
*Attorney, Agent, or Firm*—Fish & Richardson P.C.

[57] ABSTRACT

A coin jam detection system for detecting a coin jammed in a coin runway of vending machines, or other coin operated machines is described. The system includes a coin runway sensor attached to a coin runway, a coin sensor and a microprocessor. A timer in the microprocessor is used to measure the time elapsed between when a coin is sensed by the coin runway sensor and by the coin sensor in the coin mechanism. If the timer exceeds a certain predetermined time limit, a jam condition is assumed and a repair signal may be generated.

12 Claims, 10 Drawing Sheets

DETECTION SYSTEM

The present invention concerns a device and method for use in vending machines and coin operated machines to detect fraud and coin jams. More particularly, the invention relates to a set of coin sensors that record the time a coin travels in a coin runway.

BACKGROUND OF THE INVENTION

In the operation of vending machines and other coin operated machines, coins are inserted into a slot and then travel through a runway to a coin validator, acceptor or other type of coin mechanism. The coin validator determines whether the coin is genuine, and if so the coin is routed to a collection box or stack. Coins can sometimes stick in the coin runway before reaching the coin mechanism. Furthermore, coin operated machines are subject to vandalism. One form of fraud is to attach a string to a coin, insert the coin into the slot and, after activation of the coin mechanism, withdraw the coin from the vending machine.

In the operation of a damage- and debris-free coin runway, inserted coins travel to the coin mechanism within a set time or tolerance range. If a coin becomes jammed in the coin runway due to either debris or a fraud attempt, the coin will either never arrive at the coin mechanism or take longer to reach the coin mechanism than expected. The vending machine may become inoperable and may require maintenance. It is desirable to have a coin operated machine that will detect coin jams and tampering.

SUMMARY OF THE INVENTION

A coin jam detection system is described. The system includes a runway sensor, a coin sensor and a microprocessor attached to the runway sensor and coin sensor, the microprocessor starting a timer sequence when a first signal is received from the runway sensor and ending the sequence when either a second signal is received from the coin sensor or a predetermined value is exceeded is disclosed. In an embodiment the microprocessor is the coin validator microprocessor. In another embodiment, the microprocessor is a vend controller microprocessor. The runway and coin sensors may be, but are not limited to, optical, mechanical and inductive sensors.

In another embodiment, a coin detection system includes a coin runway sensor, a coin validator sensor, and a timer connected to the coin runway sensor and the coin validator sensor. The timer receives a first signal from the coin runway sensor when a coin passes by the coin runway sensor, and receives a second signal from the coin validator sensor when the coin passes by the coin validator sensor. In an embodiment, a vend controller is connected to the coin runway sensor, the coin validator sensor and the timer, and the vend controller receives the first signal from the coin runway sensor, and the second signal from the coin validator sensor.

A method of detecting a coin jammed in a coin ramp includes generating a first coin detection signal, generating a second coin detection signal, calculating a time value equal to the time between the first and the second coin detection signals, comparing the time value to a predetermined time range of values, and generating a jam signal if the time value is outside of the predetermined range. In an embodiment, the method further includes generating a repair signal, which may be communicated to a central office by telemetry means. In yet another embodiment the method includes generating a "not in service" signal to a consumer using a vending machine.

An apparatus and method according to the invention provides an inexpensive attachment to existing coin mechanisms and coin runways for detecting possible jam conditions, including actual coin jams in the coin runway and various attempted frauds in vending machines.

DETAILED DESCRIPTION

Figure 1:
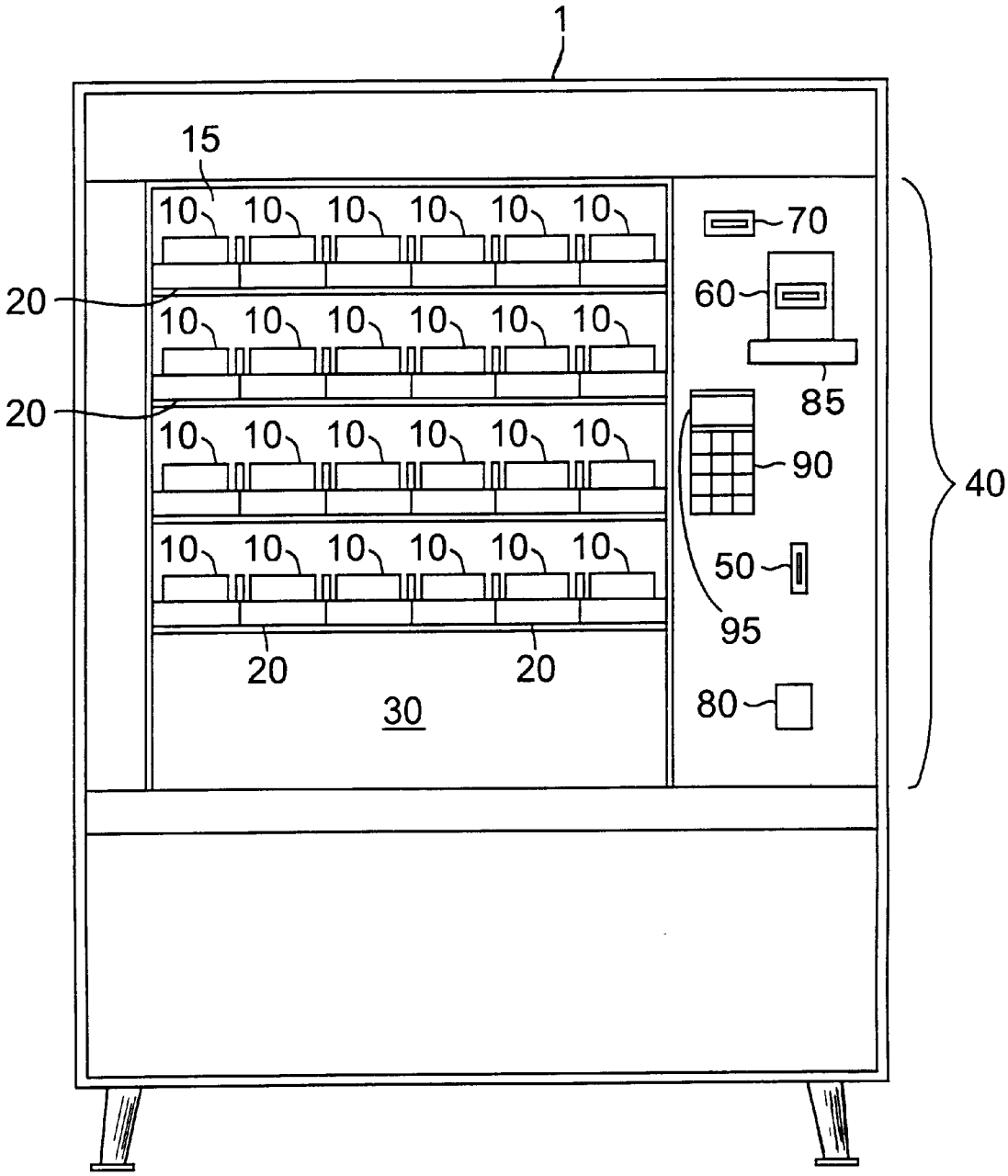
FIG. 1 PRIOR ART
FIG. 1 illustrates a front view of a conventional vending machine.

FIG. 1 depicts a typical vending machine 1 which contains a variety of products 10 to be dispensed which are stored in an area inaccessible to customers, such as behind a glass panel. Each product 10 is retained by a product delivery apparatus 20 which is selectively actuable to dispense the product into a delivery area 30 that is accessible to the customer. Suitable product delivery apparatus 20 include vend motors and solenoids as well as other delivery devices that are known in the art.

A control panel 40 of the vending machine 1 contains a coin slot 50, a banknote or bill insert slot EO, various currency acceptance means such as a card acceptor 70 to enable customers to initiate a transaction with a credit or debit card, or with an electronic purse device in the form of a card. A coin return 80, a bill payout recess 85 and an item selector such as a keypad 90 are also provided in the control panel 40. A display 95 on the control panel 40 may provide instructions and information to the customer. Suitable displays 95 include dot-matrix displays, selectively activatable message lights, an electronic scrolling message, or other displays capable of operating in the environmental conditions to which automatic transaction systems are typically exposed.

A customer may initiate a transaction by depositing coins or bills of particular denominations in the slots 50 or 60, respectively. The customer may also insert an electronic purse device, or a debit or credit card in the card acceptor 70 to initiate a transaction. Once sufficient payment has been deposited in the automatic transaction system 1, the customer may select a product 10 to be dispensed using the keypad 90. The corresponding product delivery apparatus 20 will then dispense the selected product 10 to the product delivery area 30 where it may be retrieved by the customer. Any resulting change from the transaction may be paid out through the coin return 80, the bill payout recess 85 or credited to an inserted electronic purse device.

Figure 2:
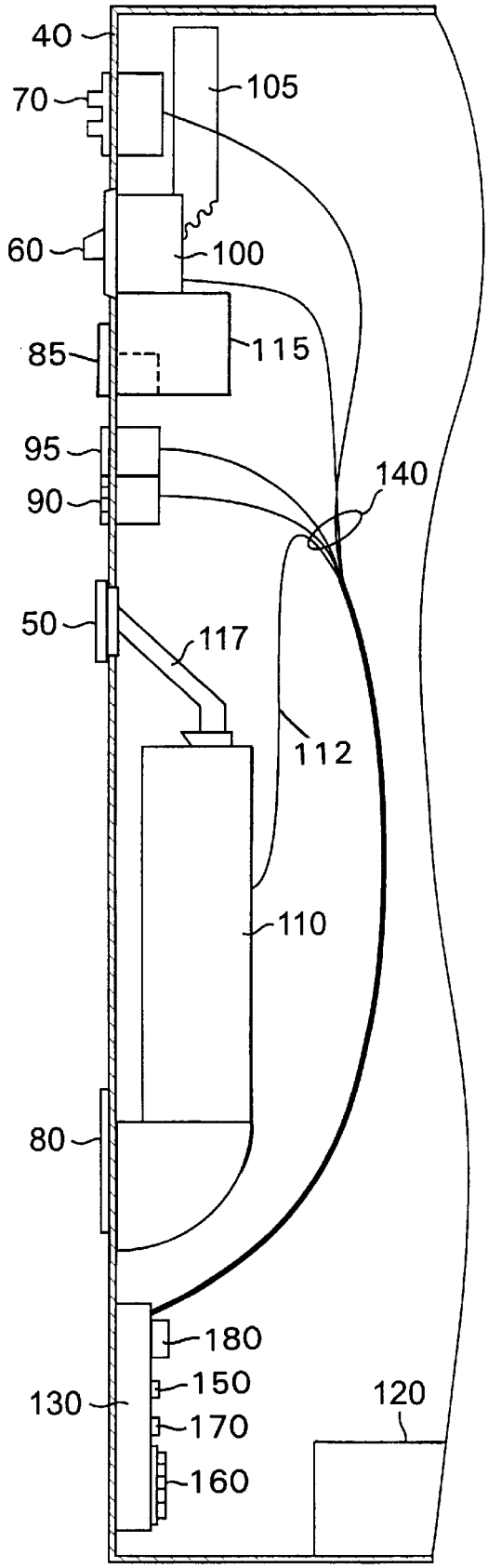
FIG. 2 PRIOR ART
FIG. 2 illustrates a cutaway side view of the front panel of the vending machine of FIG. 1.

FIG. 2 is an internal cutaway side view of the vending machine of FIG. 1 showing a typical component layout along the control panel 40. Money acceptors such as bill validator 100 and an associated bill stacker 105, and a coin mechanism 110, are attached to the rear of the control panel 40 adjacent the bill insert slot 60 and coin slot 50. The coin mechanism 110 and bill validator 100 are capable of discriminating coins and bills.

A bill escrow and payment unit 115 is positioned adjacent the bill payout recess 85 and is connected to the bill validator 100. The bill escrow and payout unit 115 is capable of dispensing bills as change through the bill payout recess 85. The bill validator 100 may divert deposited acceptable bills to the bill escrow and payout unit 115 to replenish its supply of bills for change. A cashbox 120 is also included in the vending machine 1.

The bill validator 100, coin mechanism 110, bill escrow and payout unit 115, card acceptor 70, keypad 90 and display 95 are connected to a vend controller 130 by communication lines 140. In particular, the coin mechanism 110 includes data line 112 which connects to the vend controller 130. The vend controller 130 is further connected to data entry devices, such as DIP switches 150, a keypad 160, an input/output port 170, as well as a display 180 to facilitate the entering and updating of operating data and servicing of the vending machine 1.

Figure 3:
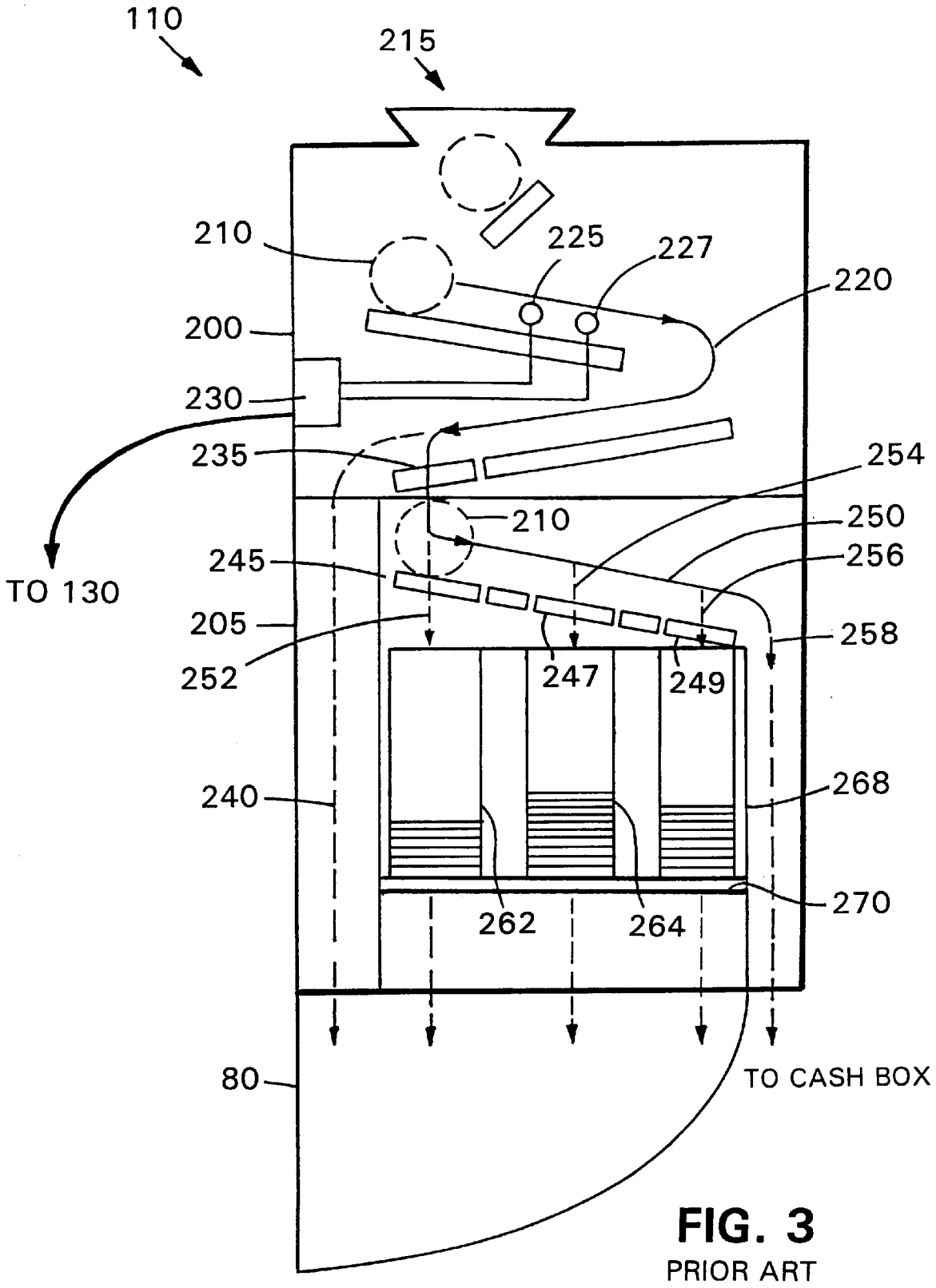
FIG. 3 PRIOR ART
FIG. 3 illustrates a front cutaway view of a conventional coin mechanism.

FIG. 3 depicts a coin mechanism consisting of a coin validator 200 and a coin separator 205. The coin validator 200 receives coins 210 through a coin cup 215 which is connected to the coin runway 117 (FIG. 2). The coin 210 travels along a path 220 in the coin validator 230 past two sensors 225, 227.

The sensors 225, 227 generate electrical signals which are provided to a coin mechanism processor 230 such as a microprocessor or microcontroller. The processor 230 is also connected to the vend controller 130 (FIG. 2) via communication lines 140 (FIG. 2). The electrical signals generated by the sensors 225, 227 contain information corresponding to the measured characteristics of the coin 210 such as the diameter, thickness, metal content, and electromagnetic properties. Based on these electrical signals, the processor 230 is able to discriminate whether the coin 210 is acceptable, and if so, the denomination. The coin mechanism processor 230 provides information concerning the denomination of accepted coins to the controller 130 over communication lines 140.

If the coin 210 is unacceptable, the processor 230 controls a gate 235 to direct the unacceptable coin 210 to a reject chute 240. The reject chute 240 is connected to the coin return 80 (FIGS. 1 and 2). In the alternative, acceptable coins 210 are directed to the coin separator 205 by the gate 235. The coin separator 205 may have a number of gates 245, 247, 249, also controlled by signals from the processor 230 for diverting the coin 210 from the main path 250. The coin 210 may be diverted into respective paths 252, 254, 256 or the coin 210 may be allowed to proceed along path 250 to path 258 leading to the cash box 120 (FIG. 2).

Each of the paths 252, 254, 256 leads to a respective one of three coin tubes or containers 262, 264, 266. Each of these coin tubes 262, 264, 266 is arranged to store a vertical stack of coins of a particular denomination. Only three of the containers are shown, but more may be provided. Further, the coin mechanism 110 may utilize passive routing techniques, instead of the gates 245, 247, 249 for diverting the coin 210 from the path 250.

A dispenser 270 associated with the coin tube 262, 264, 266 is operable to dispense coins from the containers when change is to be given by the coin mechanism 110. The dispensed coins are delivered to the coin return 80. An alternative configuration may use a coin mechanism 110 that does not payout change. In such a configuration, a separate pre-loaded coin payout device may be used.

Figure 4:
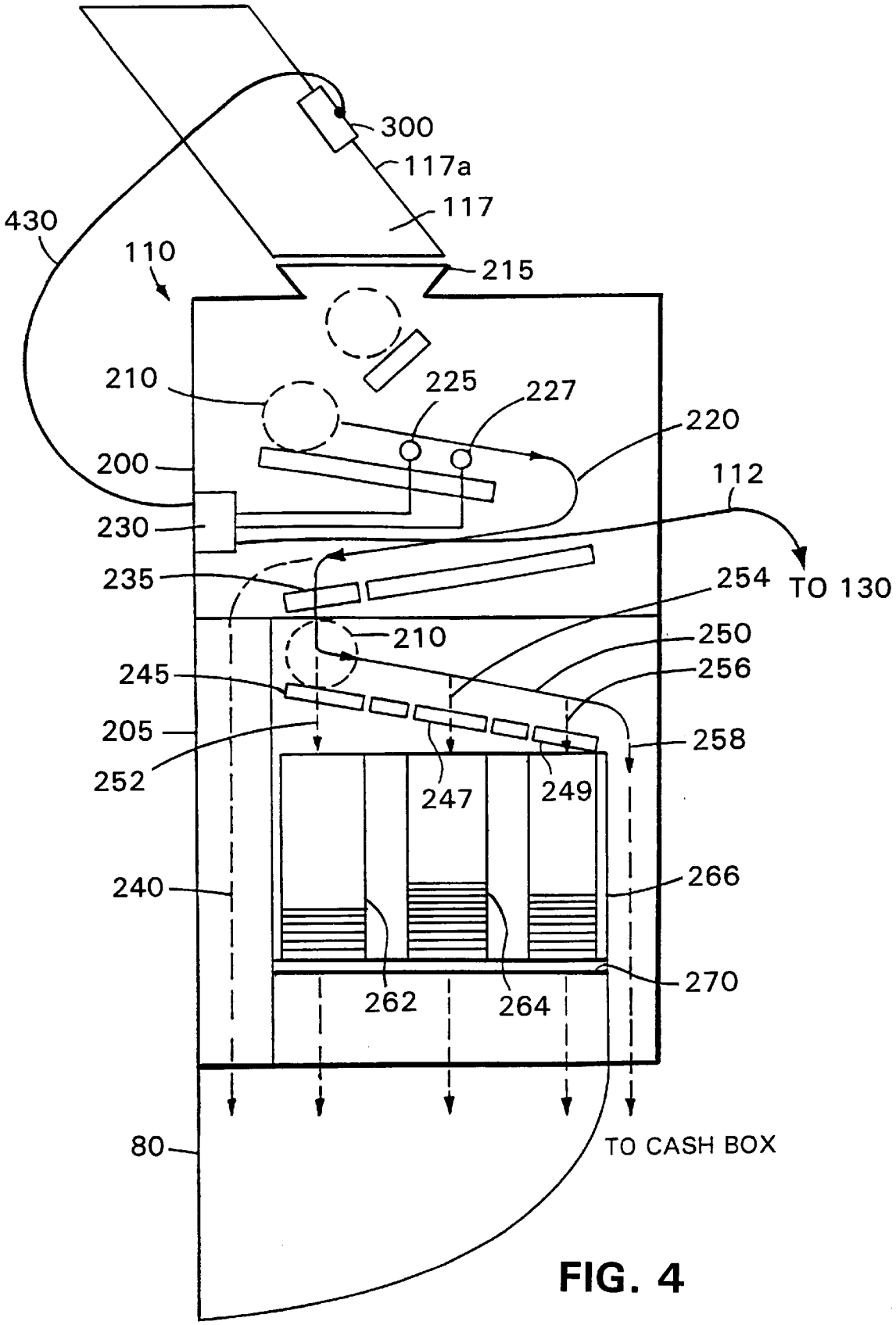
FIG. 4 illustrates a front cutaway view of an implementation of a coin sensing system according to the invention.

FIG. 4 depicts a coin mechanism 110 and associated a coin runway 117, and illustrates an implementation of a coin sensing system. The coin sensing system includes a runway sensor 300 which includes an attachment means for connecting it to the coin runway 117 for the purpose of detecting the passage of a coin. The runway sensor 300 is preferably placed as close as possible to the coin slot 50 (FIG. 2) at an upper portion 117*a* of the coin runway 117. The runway sensor 300 is placed as close as possible to thus coin slot 50 because it maximizes coverage of possible trouble areas down the coin runway 117. But other placements of the sensor 300 may be acceptable. Suitable coin detectors for implementing the runway sensor 300 include, but are not limited to, optical, mechanical and inductive sensor means. A first communication line 430 from the runway sensor 300 is connected to processor 230. Data line 112 from the processor 230 is connected to vend controller 130 (FIG. 2). One of the coin validating sensors 225, 227 may be used to detect coin arrival in the coin mechanism 110 for the purpose of detecting a jam condition. For example, typically the first coin arrival sensor 225 is used to detect coin arrival in the coin mechanism 110. The internal clock of processor 230 can be used to measure the time of passage of a coin between sensor 300 and the coin validating sensor 225. Runway sensor 300 may be used to initiate the start of a clock cycle of the internal clock of the processor 230. The coin sensor 300 signals the clock to begin counting when a coin passes the sensor 300. When the coin reaches the sensor 225. A signal is sent to the timer to stop. If the timer exceeds a certain predetermined time limit, the coin is assumed to be jammed in the coin runway 117. When a jam condition occurs, a light indicator may be lit on the coin mechanism 110 or the vend controller 130. Further, the vend controller 130 could display a repair message on the display 180, indicating the possible jam condition and a time stamp of when the jam occurred. In an implementation, the vend controller and coin mechanism may be equipped with telemetry means which can be utilized to notify the owner of the vending machine that a jam has occurred, possibly requiring service personnel to perform maintenance on the machine.

Figure 5:
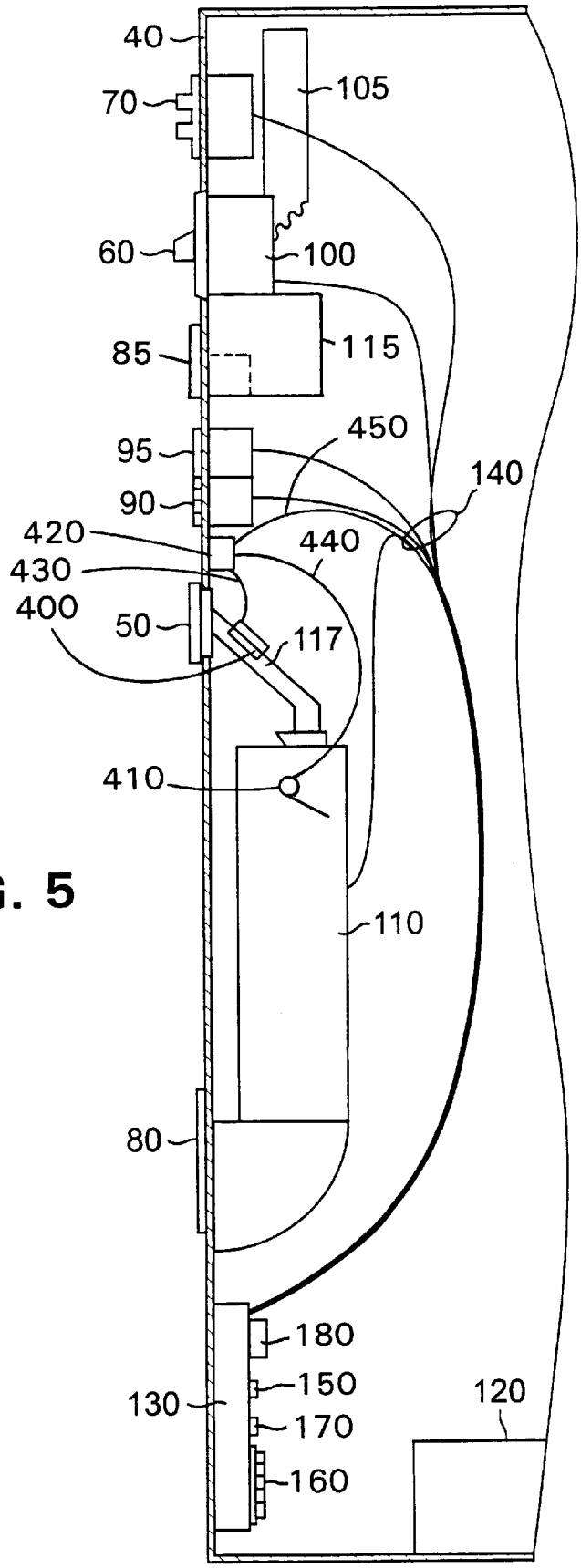
FIG. 5 illustrates a cutaway side view of a front panel of a vending machine containing an implementation of a coin sensing system according to the invention.

FIG. 5 is an internal side view of a vending machine illustrating an alternate implementation of a runway sensor system showing a component layout along the control panel 40. A timer 420 is located adjacent the coin mechanism 110. The runway sensor 400 is located above the coin passageway 117 and is connected to the timer 420 via a first communication line 430. A dedicated second sensor 410 is located in the coin mechanism 110 and is connected to the timer 420 via a second communication line 440. The runway sensor 400 signals the timer to begin counting when a coin passes, and the dedicated sensor 410 sends a signal to the timer to cease counting when it senses the coin. A communication line 450 is connected to the timer 420 and the vend controller 130. As stated above, the predetermined time can be programmed into the vend controller 130. This time can be communicated to the timer 420. When the timer 420 passes the predetermined time it can signal the vend controller 130 that a jam has occurred. When the time limit is exceeded it is assumed a jam has occurred. If a jam condition is detected, a repair signal can be transmitted from the vend controller 130. Input/output ports 170 can be used to transmit the signal to various communications means. The input/output port 170 may be attached to the internet or a Local Area Network (LAN). Other types of communications can be used such as cellular signals. The signal may contain information, such as a vending machine identification code, and a time stamp indicating when the jam occurred. Some or all of such information may also be displayed on display 180 so that service personnel can easily view the jam information when servicing the vending machine 1.

Figure 6:
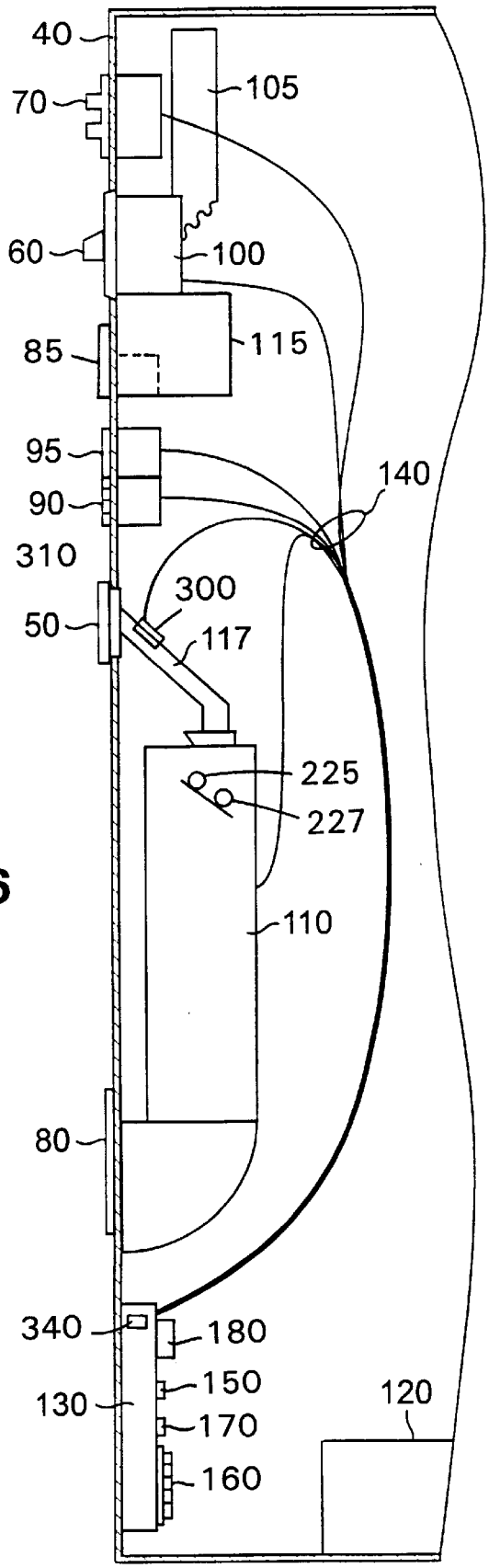
FIG. 6 illustrates a cutaway side view of a front panel of a vending machine containing another embodiment of a coin sensing system according to the invention.

FIG. 6 is an internal side view of a vending machine showing a component layout along the control panel 40 of yet another implementation of a coin sensor system. A runway sensor 300 is attached to coin runway 117 for the purpose of detecting the passage of a coin. The runway sensor 300 is preferably placed as close as possible to the coin slot 50. Suitable coin detectors for implementing the sensor 300 include optical, mechanical, inductive or other coin sensor means. A communication line 310 from the sensor 300 is connected to the vend controller 130. The coin validating sensors 225, 227 may be used to detect coin arrival in the coin mechanism 110. Coin sensor 300 may be used to initiate a timer 340 which is used to track the time between sensor 300 and either or both of the sensors 225, 227. In another implementation a separate dedicated sensor may be placed in the coin mechanism 110 for the purpose of detecting coin arrival and stopping timer 340. Coin sensor 300 may be used to initiate a timer 340 which is used to track the time between sensor 300 and either or both of the sensors 225, 227. The coin sensor 300 signals the timer to begin counting when a coin passes by the sensor 300. When the coin reaches sensors 225, 227, the sensors 225, 227 signal the timer 340 to stop. If the timer 340 exceeds a certain predetermined time limit, a signal is sent indicating that the coin is jammed in the coin runway 117.

A predetermined time limit can be programmed into the vend controller 130 and then loaded into the timer 340 via the DIP switches 150, keypad 160 or input/output port 170. In an implementation, the predetermined time limit is preloaded into the timer 340 either in software, firmware, or other programming means. In an implementation the predetermined time limit is programmed into the vend controller by software, firmware or other programming means, and then loaded into the timer 340. In another implementation, the timer 340 is an internal timer of the vend controller 130. Vend controller 130 receives signals from sensor 300 via communication line 310 to time stamp when the coin passes by it. The vend controller also receives signals from sensors 225, 227 to time Stamp when the coin reaches it. Vend controller 130 communicates the predetermined time limit to timer 340. When the timer 340 counts past the predetermined time, it signals back to the vend controller 130 indicating that the limit has been exceeded. In an implementation, the timer 340 has on-board logic to store the predetermined time limit and to communicate a signal indicating that the limit has been exceeded.

When the time limit is exceeded it is assumed a jam has occurred. If it is determined that a jam condition has occurred, a repair signal can be transmitted from the vend controller 130. Input/output ports 170 can be used to transmit the signal to various communications means. The input/output port 170 may be attached to the internet or a Local Area Network (LAN). Other types of communications can be used such as cellular signals. The signal may contain information such as a time stamp indicating when the jam occurred. This information may also be displayed on display 180 so that service personnel can easily view the jam information when servicing the vending machine 1.

The timer 340 is depicted as being part of the vend controller 130. The timer 340 may also be located in the vend controller 130 or at an external location. If used in the coin mechanism 110, the timer 340 can be an integral part of microcontroller 230. Therefore, signals from the timer 340 can be sent to vend controller 130 via communication lines 140.

Figure 7:
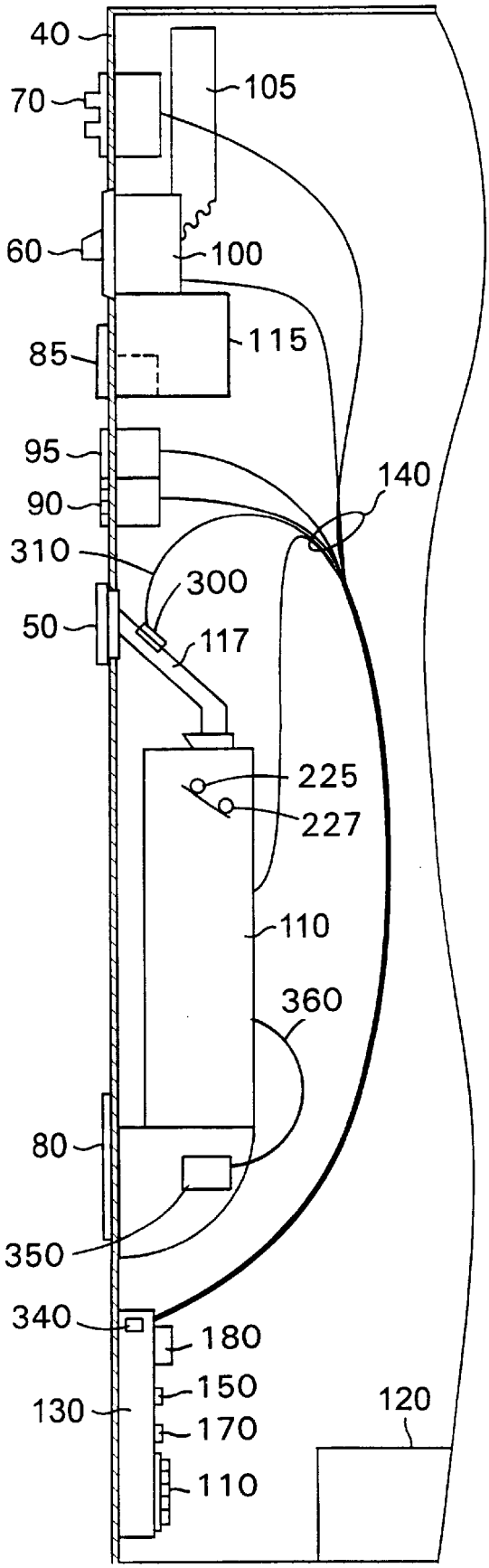
FIG. 7 illustrates a cutaway side view of a front panel of a vending machine containing another embodiment of a coin sensing system according to the invention.

FIG. 7 is an internal side view of a vending machine showing a component layout along the control panel 40 of yet another implementation of a coin sensor system. This embodiment is similar to the embodiment in FIG. 6 above with a runway sensor 300 is attached to coin runway 117, a communication line 310 from the sensor 300 is connected to the vend controller 130, and coin validating sensors 225, 227. Coin sensor 300 may be used to initiate a timer 340 which is used to track the time between sensor 300 and either or both of the sensors 225, 227. The operation of coin sensor 300 and the various embodiments for sensing a coin jam are similar to the discussion above. In this embodiment a dispense sensor 350 is added to the coin return path 80. A communication line 360 connects the sensor 350 to the coin mech 110. The dispense sensor 350 may alternately be connected to the vend controller 130. This dispense sensor 350 will operate to detect at least one of the following conditions: if the change dispenser was supposed to dispense change, but no change reached the coin return area 80 which may indicate a jam condition; fraud is attempted as a metallic object is inserted into and/or past the change receptacle 80 which may cause damage to the coin changer in the coin mech 110; or a fraud is attempted as a caustic or flammable fluid is poured into the change receptacle 80. Therefore the dispense sensor 350 is not limited to detecting the jam conditions as stated above.

Suitable detectors for implementing the dispense sensor 350 include but are not limited to optical, mechanical, and inductive sensor means. Optical and mechanical sensors are useful when objects are inserted into the coin return area 80. Inductive sensors are useful when liquids are injected into the coin return area 80. Typically these fluids will have conductive characteristics that will bridge connectors associated with inductive sensors.

In one embodiment, once the coin dispenser is instructed to dispense change, a signal is sent to a timer (in this embodiment timer 340 is used) to begin a timing sequence. If the dispensed coins reach the dispense sensor 350 before a predetermined time limit is reached the timer will stop timing. However, if the change dispenser is instructed to dispense coins, and the timing sequence starts, but one or more coins are not dispensed for whatever reason, such as a broken change dispenser, or a coin jam, no coin will pass the dispense sensor 350 to stop the timing sequence. Therefore, the predetermined time limit will be surpassed, and the vend controller 130 (or coin mech 110) will generate a coin jam condition signal.

Customers sometimes legitimately insert their fingers into the coin return area 80 to retrieve change, which actions will be sensed by the dispense sensor 350. Therefore, a predetermined time limit is set to reflect this condition.

If a fraud is attempted such as pouring a liquid or inserting an object in the coin return area 80, the dispense sensor 350 will detect such events and trigger the timing sequence. If the timing sequence passes the predetermined limit, it is assumed that an object or fluid has been inserted, and the vend controller 130 or coin mech will generate a jam condition signal.

Figure 8:
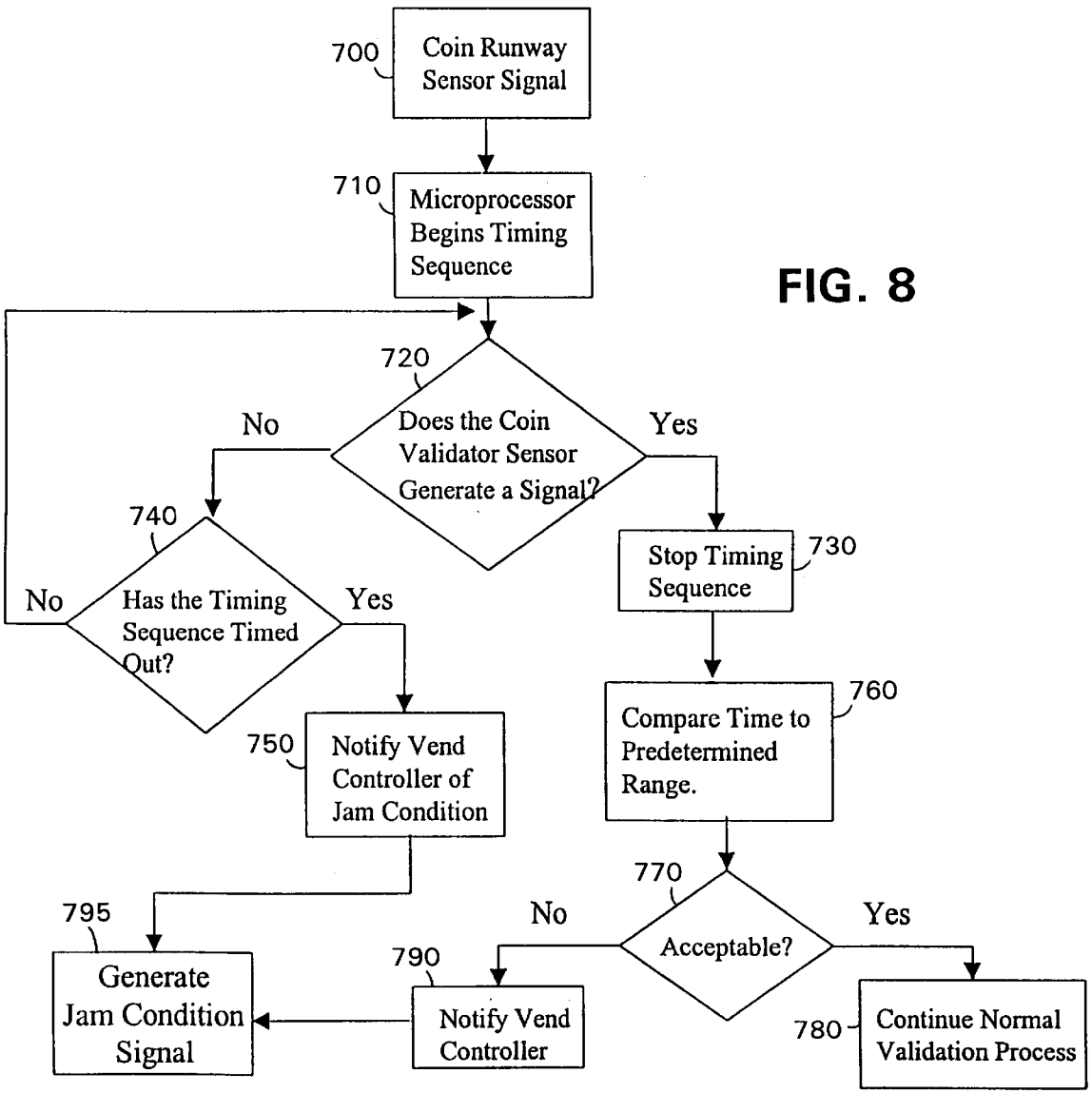
FIG. 8 is a flowchart of a coin sensing method according to the invention.

FIG. 8 is a flowchart of a method of detecting a coin jam condition in a coin runway. In step 700, a coin passes by a coin runway sensor and generates a signal. Next in step 710, a microprocessor of either the coin mechanism, the vend controller or a stand alone unit begins a timing sequence. As a coin advances in the runway to the coin mechanism, the timer continues to count. When an initial value of an acceptable timing range is reached in step 720, it is then determined whether or not a coin mechanism sensor generates a signal. If so, then in step 730 the timing sequence is stopped. If not, then in step 740 it is checked whether the timing sequence has timed out according to a predetermined time limit. If it has timed out, then a jam condition is assumed and in step 750 the vend controller is notified. The vend controller in step 795 then generates a jam condition. However, if in step 740 the timing sequence has not timed out, then in step 720 the microprocessor awaits a further signal from the coin validator. If the signal is received the timing sequence is stopped in step 730 and in step 760, it is compared to the predetermined range. In step 770 if the count falls within the predetermined range, then in step 780 the normal coin validation process is continued. In step 770, if the count is not within the range, then in step 790 the vend controller is notified. The vend controller can then generate a jam condition 795 which may be a repair signal, and indicate an "out of service" display to the consumer.

Figure 9:
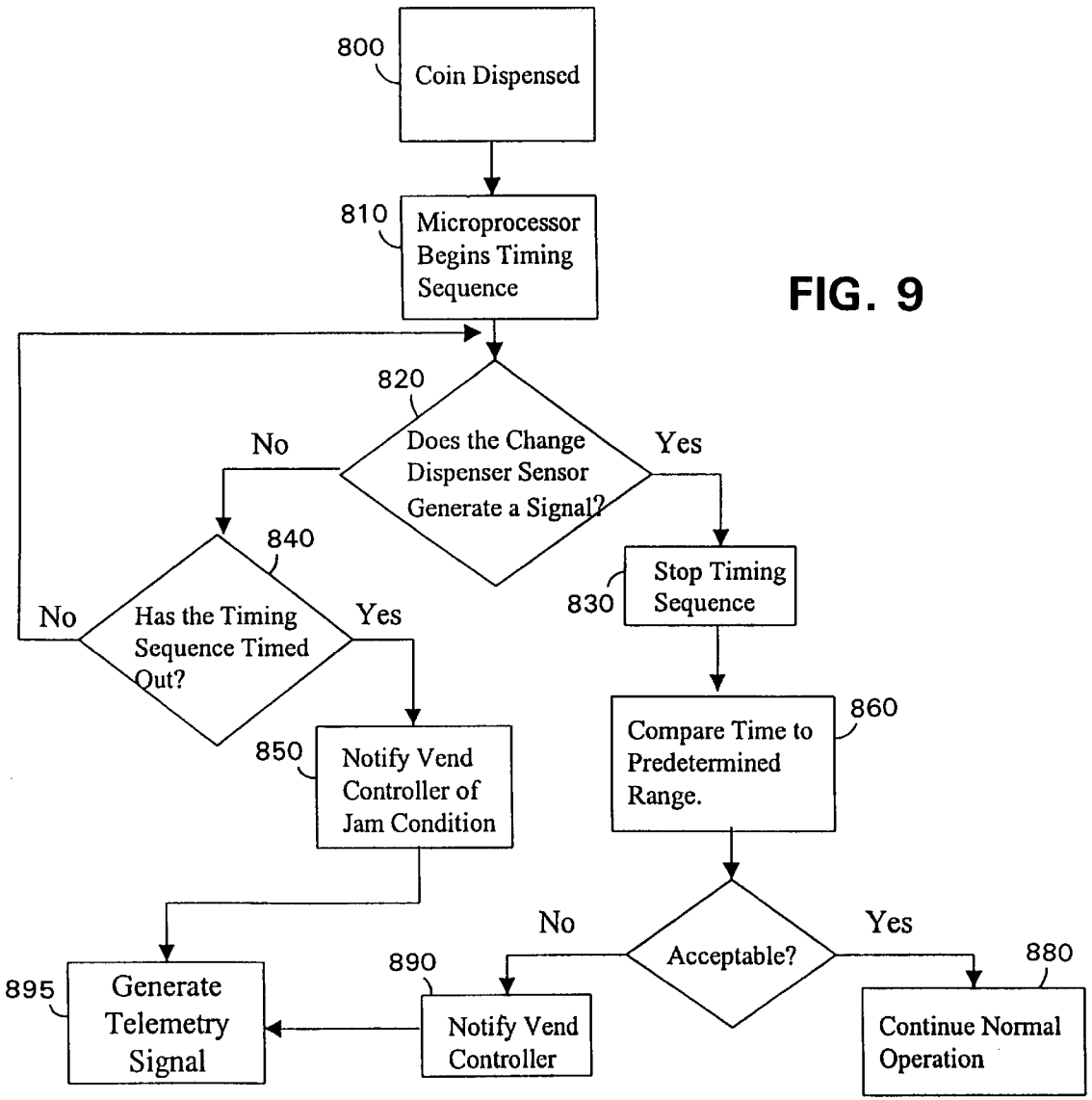
FIG. 9 is a flowchart of a coin sensing method according to the invention.

FIG. 9 is a flowchart of a method of detecting a coin jam condition in a coin return area or coin dispenser. In step 800, a coin is dispensed by a coin dispenser. Next in step 810, a microprocessor of either the coin mechanism, the vend controller or a stand alone unit begins a timing sequence. As a coin advances toward the coin return area, the timer continues to count. When an initial value of an acceptable timing range is reached in step 820, it is then determined whether or not a coin mechanism sensor generates a signal. If so, then in step 830 the timing sequence is stopped. If not, then in step 840 it is checked whether the timing sequence has timed out according to a predetermined time limit. If it has timed out, then a jam condition is assumed and in step 850 the vend controller is notified. The vend controller in step 895 then generates a jam condition. However, if in step 840 the timing sequence has not timed out, then in step 820 the microprocessor awaits a further signal from the coin return area sensor. If the signal is received the timing sequence is stopped in step 830 and in step 860, it is compared to the predetermined range. In step 870 if the count falls within the predetermined range, then in step 880 the vending machine continues normal operation. In step 870, if the count is not within the range, then in step 890 the vend controller is notified. The vend controller can then generate a jam condition 895 which may be a repair signal, and indicate an "out of service" display to the consumer.

Figure 10:
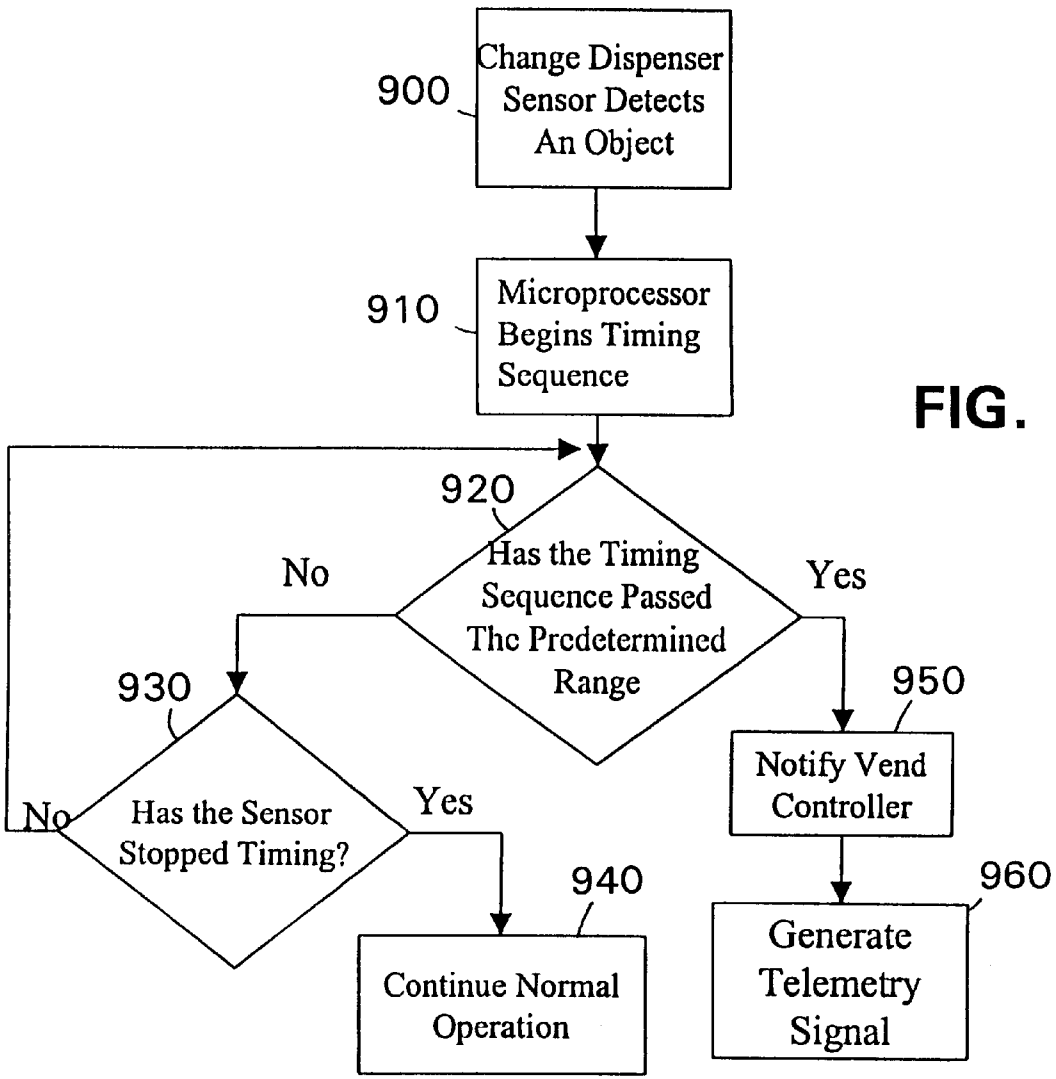
FIG. 10 is a flowchart of a coin sensing method according to the invention.

FIG. 10 is a flowchart of a method of detecting a fraud condition in a coin return area. In step 900 the dispense sensor in the coin return area detects the presence of a solid or liquid. This event may be a consumer's fingers simply collecting dispensed coins, or it may be an attempted fraud such as an insertion of an object or injection of a liquid. In step 910, a microprocessor in a coin mech or vend controller begins a timing sequence. In step 920 it is determined whether the timing sequence has passed a predetermined range. If it has not, then in step 930, it is checked whether the sensor has stopped the timing sequence. The timing sequence will stop if the object is removed. If the object is removed within the predetermined range, then normal operation is continued in step 940. If the sensor is continuing to sense. an object in step 930, then it is determined if the predetermined range has been passed in step 920. If the range is passed, then the vend controller is notified in step 950, and a telemetry signal is generated in step 960. The vend controller can then generate a jam condition which may be a repair signal, and indicate an "out of service" display to the consumer. The indication of an "out of service" display may deter the person attempting the fraud from any further activity.

Certain implementations have been described, but various modifications and additions may be made which still fall within the scope of the claims.

What is claimed is:

1. A method of detecting an attempted fraud when an object is inserted or a fluid is injected into a coin return area, comprising;

generating a detection signal for as long as the object or the fluid is present in the coin return area;

calculating a time value equal to the time elapsed while the object or the fluid is present in the coin return area;

comparing the time value to a predetermined time range of values; and generating a fraud condition signal if the time value is outside of the predetermined range.

2. The method of claim 1 further comprising transmitting the fraud signal to a coin mechanism.

3. The method of claim 1 further comprising transmitting the fraud signal to a controller.

4. The method of claim 1 further comprising generating a repair signal.

5. The method of claim 1 further comprising communicating the fraud signal via a telemetry device to a central office.

6. The method of claim 1 further comprising generating an "out of service" indication.

7. A detection system for a vending machine comprising:

a coin runway;

a runway sensor associated with the coin runway and adapted to generate a first signal when an object is detected;

a second sensor associated with a coin validator and adapted to generate a second signal when the object is detected;

a dispense sensor associated with a coin return portion and adapted to generate a dispense detect signal when an object or a liquid is detected; and a control means connected to the runway sensor, the second sensor and the dispense sensor, and operable to start a first timer sequence when the first signal is received and end the sequence when either the second signal is received or a predetermined value is exceeded, operable to initiate a dispense timer sequence and end it when the dispense detect signal is detected or when the second timer sequence exceeds a predetermined value, and operable to generate at least one of a coin jam signal and a fraud signal if at least one predetermined condition occurs.

8. The apparatus of claim 7 wherein the control means is a coin validator microprocessor.

9. The apparatus of claim 7 further comprising a vend controller attached to the control means.

10. The apparatus of claim 7 wherein the runway sensor, the second sensor and the dispense sensor comprise at least one of an optical sensor, a mechanical sensor, an electronic sensor and an inductive sensor.

11. The apparatus of claim 7 further comprising a telemetry means for communicating at least one of a jam condition and a fraud condition.

12. The apparatus of claim 7 further comprising an indicator for presenting an "out of service" message if a jam condition or a fraud condition is sensed.

* * * * *